US010619438B2

(12) United States Patent
Fripp et al.

(10) Patent No.: US 10,619,438 B2
(45) Date of Patent: Apr. 14, 2020

(54) DISSOLVABLE WHIPSTOCK FOR MULTILATERAL WELLBORE

(71) Applicant: Halliburton Energy Services, Inc., Houston, TX (US)

(72) Inventors: Michael Linley Fripp, Carrollton, TX (US); Mark C. Glaser, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 125 days.

(21) Appl. No.: 15/556,210

(22) PCT Filed: Dec. 2, 2016

(86) PCT No.: PCT/US2016/064676
§ 371 (c)(1),
(2) Date: Sep. 6, 2017

(87) PCT Pub. No.: WO2018/101960
PCT Pub. Date: Jun. 7, 2018

(65) Prior Publication Data
US 2018/0371860 A1 Dec. 27, 2018

(51) Int. Cl.
*E21B 29/06* (2006.01)
*E21B 7/06* (2006.01)

(52) U.S. Cl.
CPC ..... *E21B 29/06* (2013.01); *E21B 7/06* (2013.01); *E21B 7/061* (2013.01)

(58) Field of Classification Search
CPC ..... E21B 29/06; E21B 7/061
See application file for complete search history.

(56) References Cited

U.S. PATENT DOCUMENTS 2,509,144 A * 5/1950 Grable ..... E21B 7/061 166/117.6
5,479,986 A 1/1996 Gano et al.
(Continued)

FOREIGN PATENT DOCUMENTS

CN 104096833 A 10/2014
WO 2015/187297 A1 12/2015
WO 2016/099439 A1 6/2016

OTHER PUBLICATIONS

Aviles, Isaac, Michael Dardis, and Gregoire Jacob. "Dissolvable Plug and Perf System Eliminates Mill-Outs in Multistage Stimulations." Journal of Petroleum Technology 67.06 (2015): 38-40.
(Continued)

*Primary Examiner* — Kipp C Wallace
(74) *Attorney, Agent, or Firm* — Scott Richardson; Baker Botts L.L.P.

(57) ABSTRACT

It may be required at a well site to create a lateral wellbore from a primary wellbore. A dissolvable whipstock assembly may be positioned within a primary wellbore to deflect a mill or drill bit to create a secondary wellbore. The dissolvable whipstock assembly may include a wear plate coupled to a whipstock. The wear plate comprises an incline or ramp to deflect a mill or drill to a casing exit or pre-milled window to create the secondary wellbore. The wear plate comprises a material that is strong enough to withstand the force applied by the drilling and is degradable or dissolvable. Any one or more components of the whipstock may be dissolvable such that at least a portion of the whipstock dissolves to form a pathway through any remaining portion of the dissolvable whipstock and the primary wellbore.

20 Claims, 3 Drawing Sheets

(56) References Cited

U.S. PATENT DOCUMENTS 5,765,641 A 6/1998 Shy et al.
5,887,655 A * 3/1999 Haugen ..... E21B 7/061 166/298
6,125,937 A 10/2000 Longbottom et al.
6,145,593 A * 11/2000 Hennig ..... E21B 29/06 166/177.6
6,241,021 B1 * 6/2001 Bowling ..... E21B 41/0042 166/285
6,457,525 B1 10/2002 Scott
7,168,494 B2 1/2007 Starr et al.
7,775,286 B2 8/2010 Duphorne
8,220,554 B2 7/2012 Jordan et al.
8,231,947 B2 7/2012 Vaidya et al.
8,245,774 B2 * 8/2012 Carter ..... E21B 17/1007 166/117.5
8,485,265 B2 7/2013 Marya et al.
8,567,494 B2 10/2013 Rytlewski et al.
9,022,107 B2 5/2015 Agrawal et al.
9,033,055 B2 5/2015 McCoy et al.
2003/0192717 A1 * 10/2003 Smith ..... E21B 41/0042 175/61
2004/0108739 A1 6/2004 Beeman et al.
2006/0175059 A1 8/2006 Sinclair et al.
2007/0034384 A1 * 2/2007 Pratt ..... E21B 7/061 166/380
2008/0105438 A1 * 5/2008 Jordan ..... C22C 1/0408 166/376
2011/0048743 A1 3/2011 Stafford et al.
2013/0020084 A1 1/2013 Goodson
2015/0093589 A1 4/2015 Mazyar et al.
2015/0345255 A1 12/2015 Onuoha
2016/0326818 A1 11/2016 Lajesic

OTHER PUBLICATIONS

International Search Report and Written Opinion issued in related PCT Application No. PCT/US2016/064676 dated Aug. 21, 2017, 17 pages.
Official Action and Search Report issued in related Russian Patent Application No. 2019110134/03 dated Dec. 3, 2019; 7 pages.

* cited by examiner

DISSOLVABLE WHIPSTOCK FOR MULTILATERAL WELLBORE

CROSS-REFERENCE TO RELATED APPLICATION

The present application is a U.S. National Stage Application of International Application No. PCT/US2016/064676 filed Dec. 2, 2016, which is incorporated herein by reference in its entirety for all purposes.

TECHNICAL FIELD

The present disclosure relates generally to completing a wellbore at a well site, and more particularly to a dissolvable whipstock assembly for a multilateral wellbore.

BACKGROUND

One or more operations at a well site may require drilling a secondary wellbore from a primary or parent wellbore. The primary wellbore is drilled typically using a drill string with a drill bit at a distal end and then completed by positioning a casing string within the primary wellbore and cementing the casing string in position by circulating, for example, the cement slurry into the annular regions between the casing and the surrounding formation wall. The combination of cement and casing strengthens the parent wellbore and facilitates the isolation of certain areas of the formation behind the casing for the production of hydrocarbons to an above ground location at the earth's surface where hydrocarbon production equipment is located. In many instances, the primary wellbore is completed at a first depth, and is produced for a given period of time or volume of production. Production may be obtained from various zones of the formation by perforating the casing string.

To create a multilateral wellbore may require that the drill bit be deflected from the primary wellbore towards a secondary wellbore. It is common practice to position a whipstock in casing lining of the primary wellbore to deflect one or more mills laterally (or in an alternative orientation) relative to the casing string and thereby penetrate part of the casing to form a window or opening. A drill bit can be subsequently inserted through this window to drill the lateral or secondary wellbore to a desired length and then this secondary wellbore can be completed. Removing the whipstock after drilling the secondary wellbore may require multiple trips into the wellbore to extract the components of the whipstock increasing costs. For example, extraction of the whipstock may be labor and time intensive and may delay production and consume or tie up valuable resources.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The process of removing a whipstock after a lateral wellbore has been created or formed from a primary wellbore may consume valuable resources and delay production of hydrocarbons from a wellbore. A whipstock that is dissolvable but has a strength to endure the harsh environment associated with deflecting a drill bit or a mill during drilling of a lateral wellbore reduces the consumption of these valuable resources resulting in an overall increase in efficiency and effectiveness of a well site while reducing costs associated with the production of hydrocarbons.

Figure 1:
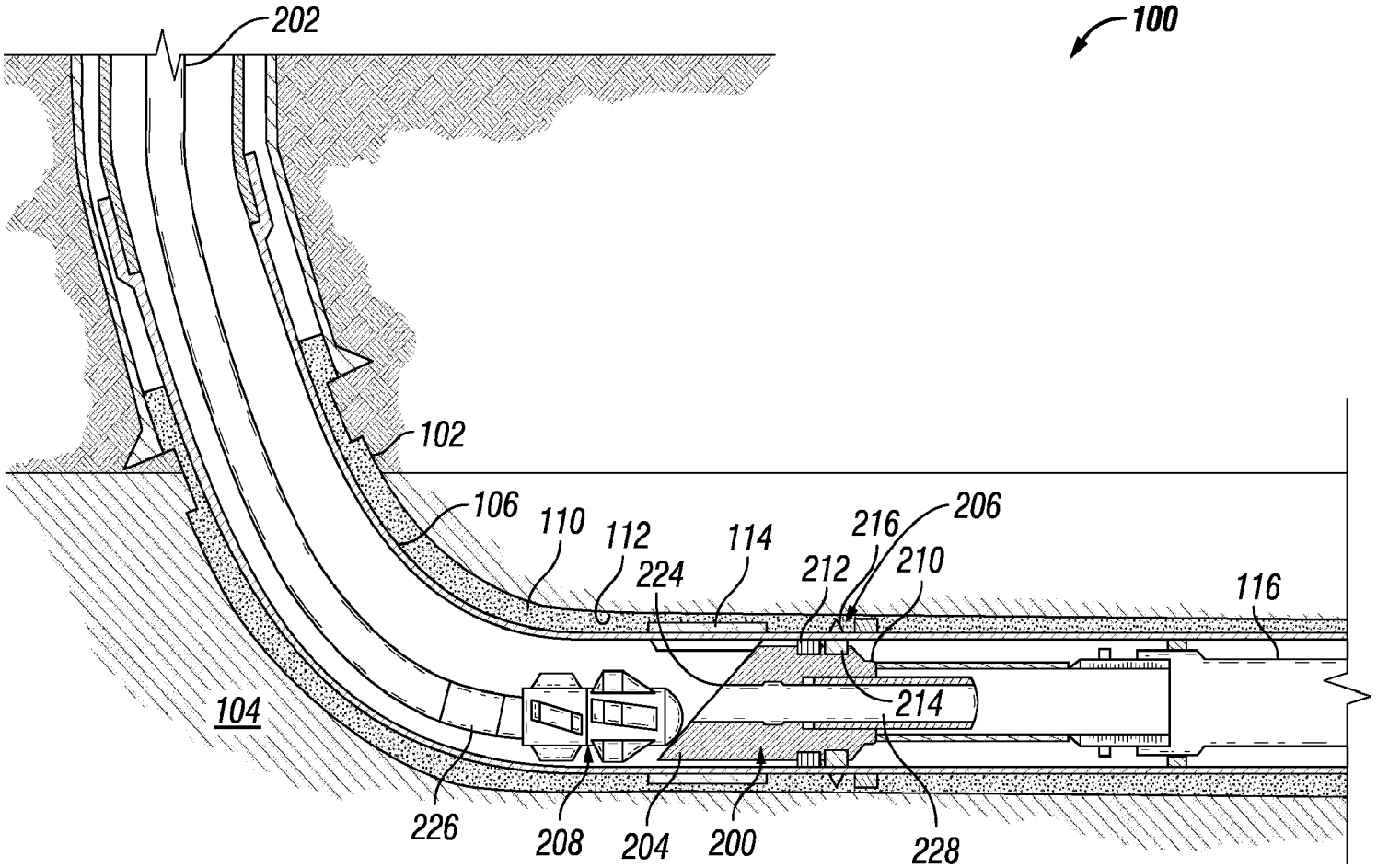
FIG. 1 is a cross-sectional view of a dissolvable whipstock assembly in a wellbore environment, in accordance with one or more aspects of the present disclosure.

Turning now to the drawings, FIG. 1 is a cross-sectional view of a dissolvable whipstock assembly in a wellbore environment, according to one or more aspects of the present disclosure. A wellbore environment 100 may comprise a primary or parent wellbore 102 that is drilled through various subterranean formations (for example, subsurface and subsea formations), including formation 104. Formation 104 may comprise a hydrocarbon-bearing formation. After one or more drilling operations have been performed, the primary wellbore 102 may be completed by lining all or a portion of the primary wellbore 102 with a liner or casing 106. All or a portion of the casing 106 may be secured within the primary wellbore 102 by depositing cement 110 within the annulus 112 defined between the casing 106 and a wall of the primary wellbore 102. In one or more embodiments, a pre-milled window 114 may be disposed or positioned within a wall of the casing 106.

After the casing 106 has been cemented, a lower liner 116 may be extended into the primary wellbore 102 and secured to the inner wall of the casing 106 at a predetermined location downhole (for example, at a predetermined distance from the pre-milled window 114 or any other predetermined location). Lower liner 116 may comprise at its distal end any one or more downhole tools or devices. In one or more embodiments, the lower liner 116 may be coupled to one or more secondary or lateral wellbores (not shown) constructed or created downhole from, for example, the pre-milled window 114 or any other location and extending from the primary wellbore 102 at a variety of angular orientations.

After a primary wellbore 102 is completed, a dissolvable whipstock assembly 200 may be disposed, conveyed or positioned in the primary wellbore 102 on a drill string 202. Drill string 202 may comprise a plurality of drilling tubulars coupled together end-to-end. Drill string 202 may comprise a tubular string, wireline, slickline, coiled tubing (wired and unwired), or any other device suitable for conveying the dissolvable whipstock assembly 200 in the primary wellbore 102. In one or more embodiments, drill string 202 is not necessary as the dissolvable whipstock assembly 200 may be pumped down primary wellbore 102. Dissolvable whipstock assembly 200 may comprise a wear plate 224, a dissolvable whipstock 204, a latch anchor 206, and a mandrel structure 228. Any one or more components of dissolvable whipstock assembly 200 may comprise a dissolvable material such that a portion or the entire dissolvable whipstock assembly 200 degrades or dissolves so that a flow path is eventually formed in the primary wellbore 102. In one or more embodiments, latch anchor 206 may comprise a dissolvable material. In one or more embodiments latch anchor 206 may comprise a non-dissolvable material, for example, steel that stays positioned against the casing 116 after completion of a drilling operation and during one or more portions of production or fluid flow through primary wellbore 102. In one or more embodiments, dissolvable whipstock 204 may be coupled to mandrel structure 228. Mandrel structure 228 provides support for the dissolvable whipstock 204. Mandrel structure 228 couples to latch anchor 206. Latch anchor 206 holds or positions the mandrel structure 228 to the casing 116.

In one or more embodiments, wear plate 224 may be coupled to the dissolvable whipstock 204 such that the mill 208 contacts or engages with the wear plate 224. Wear plate 224 may be a ramped surface, angular surface, or incline that deflects one or more mills 208 into the wall of the casing 106 to mill out a casing exit or to mill through the pre-milled window 114. The wear plate 224 prevents a mill 208 from drilling into the dissolvable whipstock 204.

In one or more embodiments, wear plate 224 may comprise a material with a high erosion resistance and a high dissolution rate. In one or more embodiments, wear plate 224 comprises a reactive, degradable metal or alloy. In one or more embodiments, wear plate 224 comprises a metal matrix or solid solution alloy degradable composite that is an abrasion resistant, erosion resistant or both composite in a dissolvable matrix. An alloy may comprise a novel alloy, a composite alloy or a hybrid alloy and may comprise a reactive metal including, but not limited to, calcium, magnesium and aluminum and at least one alloying element that includes, but is not limited to, any one or more of lithium, magnesium, calcium, gallium, indium, bismuth, zinc, and aluminum. The degradable composite, for example, the metal matrix or solid solution alloy, fades away or dissolves through galvanic degradation or corrosion process. In one or more embodiments, wear plate 224 may comprise a dispersed erosion resistant material that is bound together by a dissolvable solid solution alloy. In one or more embodiments, the dispersed erosion resistant material may comprise a ceramic including, but not limited to, zirconia, alumina, carbide, tungsten, boride, nitride, diamond, or silica. The ceramic may be an oxide or a non-oxide. In one or more embodiments, the dispersed erosion resistant material may be a hardened metal including, but not limited to, steel, indium, titanium alloys or chromium alloys. In one or more embodiments, the dispersed erosion resistant material may be a fiber or a woven mat. In one or more embodiments, wear plate 224 may comprise one or more carbide particles, for example, silicon carbide, glued or adhered together in a matrix of dissolvable material, for example, a magnesium or aluminum alloy.

In one or more embodiments, wear plate 224 may comprise a doppant added to the composite to increase and control galvanic degradation or corrosion of the wear plate 224. In one or more embodiments, the doppant may comprise any one or more of nickel, iron, copper, zinc, aluminum, titanium, or carbon. The degradable composite that includes an alloy and the dispersed erosion resistant material may be comprised of various structures, for example, a reactive metal or alloy of crystalline, amorphous or mixed crystalline and amorphous structure, a powder metallurgy like structure and a composite and hybrid structure. In one or more embodiments, the type of degradable composite including the doppant and erosion resistant material, may be selected or determined based on any one or more factors or criteria including, but not limited to, any one or more of type of formation 104, temperature, pressure, type of mill 208, rotational speed of drill string 202, desired or required rate of degradation, dissolution or corrosion, or any other factor.

During a drilling operation to create a secondary wellbore, a mill 208 may contact or engage the wear plate 224. The composite of the wear plate 224, for example, the magnesium alloy with doppant, will eventually dissolve. For example, the carbide particles of the composite of the wear plate 224 may turn to dust or small particles that are absorbed or flushed out of the primary wellbore 102 by a downhole fluid or are so small as to be of no consequence or do not impede to further drilling or production operations. In one or more embodiments, any one or more components of or the entirety of the dissolvable whipstock assembly 200 comprise a degradable metal with dispersed erosion resistant material, a doppant or both.

The latch anchor 206 may include a latch housing 210, a seal 212 and a latch profile 214. The latch profile 214 mates with a latch coupling 216 installed in the casing 106 at a predetermined location. As the dissolvable whipstock assembly 200 is lowered into the primary wellbore 102, the latch profile 214 locates, disposes, or positions in the latch coupling 216 to secure the dissolvable whipstock assembly 200 in place within the primary wellbore 102. The latch anchor 206 may orient subsequent or additional dissolvable whipstock assemblies 200 to the same predetermined angular orientation relative to, for example, the pre-milled window 114 or any other location along the casing 106. The seal 212 may be engaged and otherwise activated to prevent fluid migration across the latch anchor 206 at the interface between the latch housing 210 and the inner wall of the casing 106. The latch anchor 206 may provide support for one or more other components of the dissolvable whipstock assembly 200, including but not limited to, any one or more of the wear plate 224, the mandrel structure 228, or the dissolvable whipstock 204.

In one or more embodiments, a downhole tool or device 226, for example, a measurement-while-drilling ("MWD") tool, may orient the dissolvable whipstock assembly 200 within the primary wellbore 102 and may, at least in part, be used to locate the latch coupling 216. The tool 226 may include one or more sensors that may confirm or provide one or more measurements associated with the angular orientation of the dissolvable whipstock assembly 200. The one or more measurements may, at least in part, be used to ensure that the dissolvable whipstock 204 and the one or more mills 208 are properly oriented at a predetermined location, for example, at the pre-milled window 114.

Figure 2:
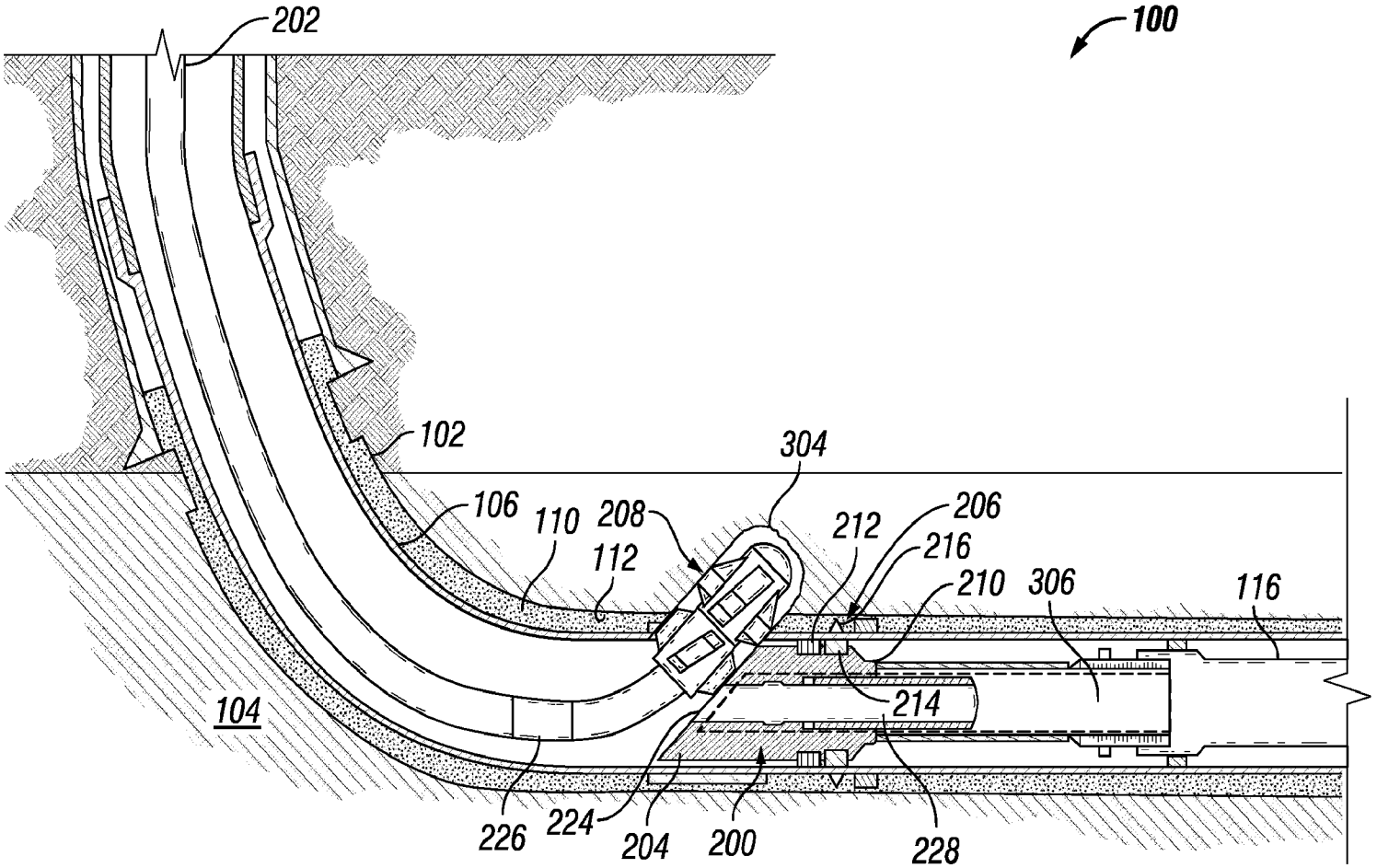
FIG. 2 is a cross-sectional view of a dissolvable whipstock assembly in a wellbore environment, in accordance with one or more aspects of the present disclosure.

FIG. 2 is a cross-sectional view of a dissolvable whipstock assembly in a wellbore environment, in accordance with one or more aspects of the present disclosure. The drill string 202 may move or direct one or more mills 208 in the downhole direction relative to the wear plate 224. The wear plate 224 directs or urges the one or more mills 208 to ride up the inclined surface of the wear plate 224. The wear plate 224 deflects the one or more mills 208 into engagement with a wall of the casing 106 or pre-milled window 114. Rotation of the one or more mills 208 via the drill string 202 mills out the casing 106 or the pre-milled window 114 to form a casing exit 302 to start a lateral or secondary wellbore 304 that extends from the primary wellbore 102. The latch seal 212 of one or more latch anchors 206 may prevent the flow of fluid to or through the primary wellbore 102. The seal 212 may comprise a degradable elastomeric or metal material. The latch anchor 206 and latch seal 212 may direct the flow of fluid to or towards the lateral wellbore 304.

In one or more embodiments, the mandrel structure 228 of dissolvable whipstock assembly 200 may comprise an opening or aperture (not shown). In one or more embodiments, after completion of a drilling operation or other operation, an erosive or corrosive fluid, for example, an acid, may be flowed or pumped into the primary wellbore 102 to erode or dissolve the wear plate 224. A retrieving or pulling tool may be engageable with the opening (not shown) of the mandrel structure 228 to retrieve any remaining or non-dissolved portions of the dissolvable whipstock assembly 200.

In one or more embodiments, the dissolvable whipstock assembly 200 may be partially dissolvable. The dissolvable whipstock assembly 200 may comprise a dissolvable core 306. One or more components of the dissolvable whipstock assembly 200 may not be dissolvable, for example, latch anchor 206, one or more portions of whipstock 204, or any other wall or component of dissolvable whipstock assembly 200. Dissolvable core 306 may dissolve, corrode or degrade during a drilling operation such that a pathway (not shown) is formed in the primary wellbore 102. In one or more embodiments, an erosive or corrosive fluid, for example, an acid, may be flowed or pumped into the primary wellbore 102 after a lateral wellbore 304 has been created. The erosive fluid may degrade, dissolve, corrode or erode the wear plate 224 exposing the dissolvable core 306. The dissolvable core 306 may dissolve during the drilling operation, after exposure to the erosive fluid or at any other time. The pathway (not shown) may allow fluid, mechanical tools or device, any other material or device, or any combination thereof to flow or be fed through the primary wellbore 102. Any non-dissolved portions of the dissolvable whipstock assembly 200 may remain in the primary wellbore 102 as a re-entry whipstock or may be retrieved at any time. In one or more embodiments, the non-dissolved portions of the dissolvable whipstock assembly 200 may be retrieved via a pulling tool (not shown) after acid has been flowed into the primary wellbore 102 to dissolve the wear plate 224. Such retrieval may require fewer resources. For example, less time may be required for removal of any one or more portions of the dissolvable whipstock assembly 200 as the non-dissolved portions of the dissolvable whipstock assembly 200 may be light and easy to extract and only a little or small amounts of acid may be required to dissolve one or more portions of the dissolvable whipstock assembly 200.

Figure 3:
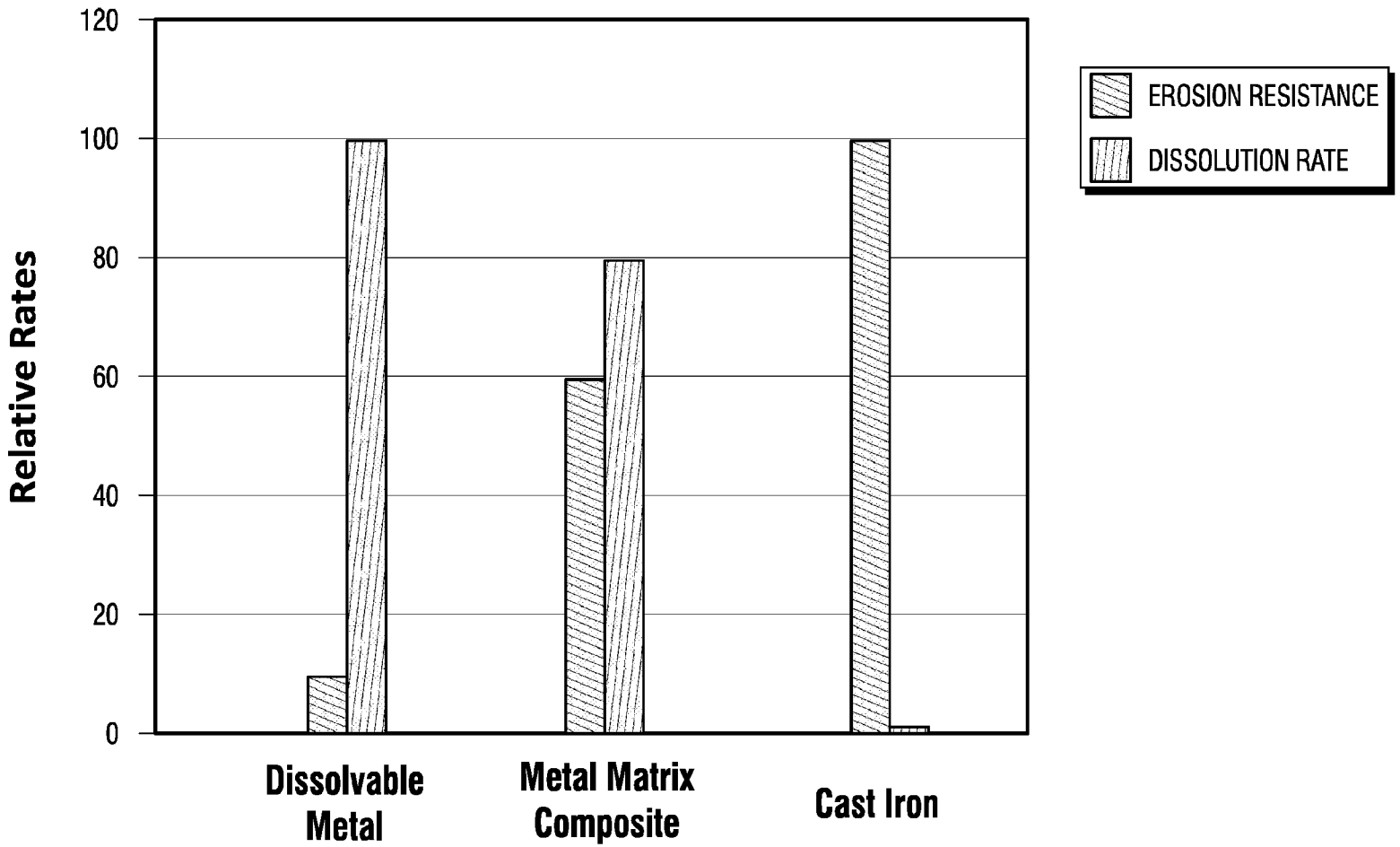
FIG. 3 is a graphical representation of erosion resistances and dissolution rates for materials of a whipstock assembly, in accordance with one or more aspects of the present disclosure.

FIG. 3 is a graphical representation of erosion resistances and dissolution rates for materials of a whipstock assembly, in accordance with one or more aspects of the present disclosure. The erosion resistances and dissolution rates for three different materials for a whipstock assembly are illustrated in FIG. 3. The results illustrated in FIG. 3 were obtained using a one horsepower pump flowing at fifteen grams per minute using twenty pounds of abrasion beads in twenty-five gallons of water. The abrasion beads comprised a 70/140 sieve size. The results were obtained after approximately one hour of pumping. FIG. 3 illustrates that a whipstock assembly that comprises a purely or mostly dissolvable metal produces a high dissolution rate but a low erosion resistance such that a mill (for example, mill 208 of FIG. 1) would easily or readily brake or drill through the whipstock assembly. A whipstock assembly that comprises a purely or mostly cast iron material produces a high erosion resistance but a low dissolution rate such that the whipstock assembly would need to be retrieved after completion of the drilling operation. A whipstock assembly, such as dissolvable whipstock assembly 200 (FIG. 1 or FIG. 2), provides a good balance between erosion resistance and dissolution rate such that a drilling operation may be completed without the added expense of retrieval of the whipstock assembly.

In one or more embodiments, a method comprises conveying a dissolvable whipstock assembly into a primary wellbore, deflecting a mill with a wear plate of the dissolvable whipstock assembly, creating a lateral wellbore by the deflected mill and eroding at least a portion of the wear plate. The method may further comprise dissolving a portion of the dissolvable whipstock assembly. The method may further comprise creating a pathway through the dissolved portion of the dissolvable whipstock assembly. The method may further comprise removing an undissolved portion of the dissolvable whipstock assembly from the primary wellbore. The method may further comprise pumping an erosion fluid into the primary wellbore and eroding the wear plate via the pumped erosion fluid. The method may further comprise positioning the dissolvable whipstock assembly in the primary wellbore based, at least in part, on one or more measurements from a downhole tool.

In one or more embodiments, a dissolvable whipstock assembly may comprise a whipstock, wherein the whipstock comprises one or more dissolvable portions and a wear plate coupled to the whipstock, wherein the wear plate comprises a composite, and wherein the composite comprises an erosion resistant material that is resistant to a mill. The system may further comprise a dissolvable core positioned within the whipstock. The system may further comprise a latch anchor coupled to the whipstock. The system may further comprise a seal positioned within the latch anchor, wherein the seal is positioned such that fluid does not migrate across the latch anchor. The system may further comprise wherein the wear plate comprises an incline. The system may further comprise a mandrel structure within the whipstock and an opening of the mandrel structure, wherein the opening is engageable with a retrieving tool. The method may further comprise wherein the composite of the wear plate comprises a doppant.

In one or more embodiments, a well system comprises a primary wellbore, a casing secured within the primary wellbore, a dissolvable whipstock assembly positioned within the primary wellbore, wherein the dissolvable whipstock assembly comprises a whipstock, wherein the whipstock comprises one or more dissolvable portions and a wear plate coupled to the whipstock, wherein the wear plate comprises a composite and wherein the composite comprises an erosion resistant material that is resistant to a mill. The well system may further comprise a drill string positioned within the primary wellbore and at least one mill of the drill string engaged with the wear plate. The well system may further comprise a lateral wellbore that extends from the primary wellbore at a casing exit, wherein the casing exit is created by a deflection of the at least one mill by the wear plate. The well system may further comprise a mandrel structure within the whipstock, an opening of the mandrel structure and a retrieving tool engaged with the opening of the mandrel structure. The well system may further comprise a dissolvable core of the whipstock. The well system may further comprise wherein the composite of the wear plate comprises a doppant. The well system may further comprise a latch anchor coupled to the whipstock, wherein the latch anchor secures the dissolvable whipstock assembly to the primary wellbore.

Although the present disclosure and its advantages have been described in detail, it should be understood that various changes, substitutions and alterations can be made herein without departing from the spirit and scope of the disclosure as defined by the following claims.

What is claimed is:

1. A method, comprising:

conveying a dissolvable whipstock assembly into a primary wellbore, wherein the whipstock assembly comprises a dissolvable whipstock and a wear plate coupled to a center portion of the dissolvable whipstock;

deflecting a mill with the wear plate of the dissolvable whipstock assembly;

creating a lateral wellbore by the deflected mill; and eroding at least a portion of the wear plate, wherein the wear plate prevents the mill from drilling into the dissolvable whipstock, wherein the wear plate comprises an erosion resistant dissolvable material, and wherein the material is a metal matrix or a solid solution alloy degradable composite.

2. The method of claim 1, further comprising:

dissolving a portion of the dissolvable whipstock assembly.

3. The method of claim 2, further comprising:

creating a pathway in the primary wellbore through the dissolved portion of the dissolvable whipstock assembly.

4. The method of claim 1, further comprising:

removing an undissolved portion of the dissolvable whipstock assembly from the primary wellbore.

5. The method of claim 1, further comprising:

pumping an erosion fluid into the primary wellbore; and eroding the wear plate via the pumped erosion fluid.

6. The method of claim 1, further comprising:

positioning the dissolvable whipstock assembly in the primary wellbore based, at least in part, on one or more measurements from a downhole tool.

7. A dissolvable whipstock assembly, comprising:

a whipstock, wherein the whipstock comprises one or more dissolvable portions; and a wear plate coupled to a center portion of the whipstock, wherein the wear plate comprises an erosion resistant dissolvable material, and wherein the material is a metal matrix or a solid solution alloy degradable composite, wherein the wear plate prevents the mill from drilling into the dissolvable whipstock, and wherein the material is resistant to a mill.

8. The dissolvable whipstock assembly of claim 7, further comprising:

a dissolvable core positioned within the whipstock.

9. The dissolvable whipstock assembly of claim 7, further comprising:

a latch anchor coupled to the whipstock.

10. The dissolvable whipstock assembly of claim 9, further comprising:

a seal positioned within the latch anchor, wherein the seal is positioned such that fluid does not migrate across the latch anchor.

11. The dissolvable whipstock assembly of claim 7, wherein the wear plate comprises at least one of an incline and a doppant.

12. The dissolvable whipstock assembly of claim 7, further comprising:

a mandrel structure within the whipstock; and an opening of the mandrel structure, wherein the opening is engageable with a retrieving tool.

13. The dissolvable whipstock assembly of claim 7, wherein the composite of the wear plate comprises a magnesium alloy.

14. A well system, comprising:

a primary wellbore;

a casing secured within the primary wellbore;

a dissolvable whipstock assembly positioned within the primary wellbore, wherein the dissolvable whipstock assembly comprises:

a whipstock, wherein the whipstock comprises one or more dissolvable portions; and a wear plate coupled to a center portion of the whipstock, wherein the wear plate prevents the mill from drilling into the dissolvable whipstock, wherein the wear plate comprises an erosion resistant dissolvable material, and wherein the material is a metal matrix or solid solution degradable composite, and wherein the material is resistant to a mill.

15. The well system of claim 14, further comprising:

a drill string positioned within the primary wellbore; and at least one mill of the drill string engaged with the wear plate.

16. The well system of claim 14, further comprising:

a lateral wellbore that extends from the primary wellbore at a casing exit, wherein the casing exit is created by a deflection of the at least one mill by the wear plate.

17. The well system of claim 14, further comprising:

a mandrel structure within the whipstock;

an opening of the mandrel structure; and a retrieving tool engaged with the opening of the mandrel structure.

18. The well system of claim 14, further comprising:

a dissolvable core of the whipstock.

19. The well system of claim 14, wherein the composite of the wear plate comprises a doppant.

20. The dust control method of claim 14, further comprising:

a latch anchor coupled to the whipstock, wherein the latch anchor secures the dissolvable whipstock assembly to the primary wellbore.

* * * * *